United States Patent [19]

Patterson

[11] 3,975,790

[45] Aug. 24, 1976

[54] CLEANING APPARATUS HAVING ULTRAVIOLET LAMP FIXTURE

[76] Inventor: Lawrence Patterson, 28745 Berrywood Lane, Farmington Hills, Mich. 48024

[22] Filed: Jan. 2, 1975

[21] Appl. No.: 537,917

Related U.S. Application Data

[63] Continuation-in-part of Ser. No. 514,600, Oct. 11, 1974, which is a continuation-in-part of Ser. No. 374,576, June 28, 1973, Pat. No. 3,846,072.

[52] U.S. Cl. ..... 15/339; 21/DIG. 2; 55/279; 250/435

[51] Int. Cl.[2] ..... A47L 7/04

[58] Field of Search ..... 250/435, 436, 437, 438, 250/455, 504, 432; 55/279; 21/DIG. 2; 15/339

[56] References Cited

UNITED STATES PATENTS

| | | | |
|---|---|---|---|
| 2,279,810 | 4/1942 | Arnott | 250/435 |
| 2,347,954 | 5/1944 | Kiely | 250/435 |
| 2,413,704 | 1/1947 | Glatthar et al. | 250/435 |
| 2,648,396 | 8/1953 | Kirby | 15/339 X |
| 3,653,185 | 4/1972 | Scott et al. | 250/435 X |
| 3,700,406 | 10/1972 | Landry | 250/437 X |

FOREIGN PATENTS OR APPLICATIONS

| | | | |
|---|---|---|---|
| 910,229 | 10/1962 | United Kingdom | 15/339 |

*Primary Examiner*—Billy J. Wilhite
*Assistant Examiner*—C. K. Moore
*Attorney, Agent, or Firm*—Basile and Weintraub

[57] ABSTRACT

An ultraviolet lamp fixture used in combination with a conventional, commercial vacuum cleaner for the purpose of purifying the air within a room. The air, after being drawn into the vacuum cleaner and having the dirt particles removed, is exhausted into a U-shaped housing which is carried by the vacuum cleaner and which contains a plurality of longitudinally mounted ultraviolet ray tubes. When the air passes over these tubes, micro-organisms contained in the air are killed by exposure to the ultraviolet radiation emitted from the tubes. The purified air is then returned to the room through an aperture in the housing. The ultraviolet light fixture may be adapted to be used with an existing conventional vacuum cleaner as shown in this specification, or a new combination light fixture-vacuum cleaner may be manufactured.

4 Claims, 5 Drawing Figures

CLEANING APPARATUS HAVING ULTRAVIOLET LAMP FIXTURE

CROSS REFERENCE TO RELATED PATENT APPLICATIONS

The present application is a continuation-in-part of copending U.S. patent application Ser. No. 514,600 filed 10-11-74 which, in turn, is a continuation-in-part of U.S. patent application Ser. No. 374,576 filed 6-28-73 and now U.S. Pat. No. 3,846,072 issued 11-5-74.

BACKGROUND OF THE INVENTION

1. Field of the Invention

The present invention relates to an improved ultraviolet light fixture and, specifically, an ultraviolet light fixture designed to be used in combination with a vacuum cleaner for the purpose of providing a compact and aesthetically pleasing means for purifying the air exhausted by such a vacuum.

2. Description of the Prior Art

The bactericidal effects of radiation emitted by ultraviolet ray tubes is well known and their use has been proposed in various applications. Examples of such ultraviolet lamps are disclosed in U.S. Pat. No. 2,248,618, U.S. Pat. No. 2,347,254, U.S. Pat. No. 2,350,462, U.S. Pat. No. 2,407,379, U.S. Pat. No. 2,732,501, U.S. Pat. No. 3,107,863 and U.S. Pat. No. 3,674,421.

In certain of the apparatuses disclosed in the aforementioned U.S. patents, ultraviolet ray tubes are employed for bactericidal radiant energy and these tubes are supported in fixtures suspended directly above the zone which is desired to be sterilized. Purification is obtained by direct exposure to the light emitted from the tubes. In some of the prior art apparatuses persons within the zone of sterilization must usually protect their eyes from the rays of the tube, or special reflective louvers to direct the radiation must be provided. These types of apparatuses are necessarily limited to the sterilization of very small areas and are suitable only for a particular situation and location as the effectiveness of the ultraviolet ray is greatly minimized if any obstructions are placed between the objects or area to be purified and the ultraviolet ray tube. Further, the effect of the ultraviolet radiation is greatly minimized beyond one meter from the tube.

In my aforementioned patents and patent applications, it was suggested that certain of the aforementioned disadvantages may be overcome by providing a means for circulating the air within a room through a fixture by means of a fan or the like so that all the air passes over concealed ultraviolet ray tubes in closer proximity thereto, thus obtaining a maximum exposure of the air to the tubes and a maximum kill of any airborne micro-organisms.

Schools, office buildings, and similar public and commercial places are usually cleaned with a conventional vacuum cleaner, which, while it removes the surface dirt from such areas, it cannot effectively purify the air with respect to micro-organisms, which, in heavy concentrations, can cause epidemics such as influenza. It has been proven medically that colonies of such organisms can and do live in contagious proportions in carpets.

The present invention combines all of the positive features of the apparatuses disclosed in my aforementioned U.S. patents and patent applications and adapts them for use with a vacuum cleaner utilizing the vacuum motor for air movement in a compact and efficient way to effect a complete cleaning of any place.

SUMMARY OF THE INVENTION

The present invention which will be described subsequently in greater detail comprises an ultraviolet light fixture used in combination with a cleaning apparatus, commonly known as a vacuum cleaner, and having means for channeling the air exhausted by the vacuum cleaner through an ultraviolet tube chamber for purification purposes before exhausting the air back into the room.

It is therefore an object of the present invention to provide a new and improved ultraviolet lamp fixture which is simple in its construction and inexpensive to manufacture, yet one which will function to purify the air inhaled by a vacuum cleaner by removing any airborne micro-organisms.

It is also an object of the present invention to provide an ultraviolet lamp fixture which, when carried by a vacuum cleaner, has a compact and aesthetically pleasing design facilitating movement and storage.

It is still a further object of the present invention to provide an ultraviolet lamp fixture having the means for concealing the ultraviolet ray tubes from the eyes of persons in a room where the fixture is in operation.

Other objects, advantages and applications of the present invention will become apparent to those skilled in the art of ultraviolet lamp fixtures when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like components throughout the several views, and in which.

Figure 1:
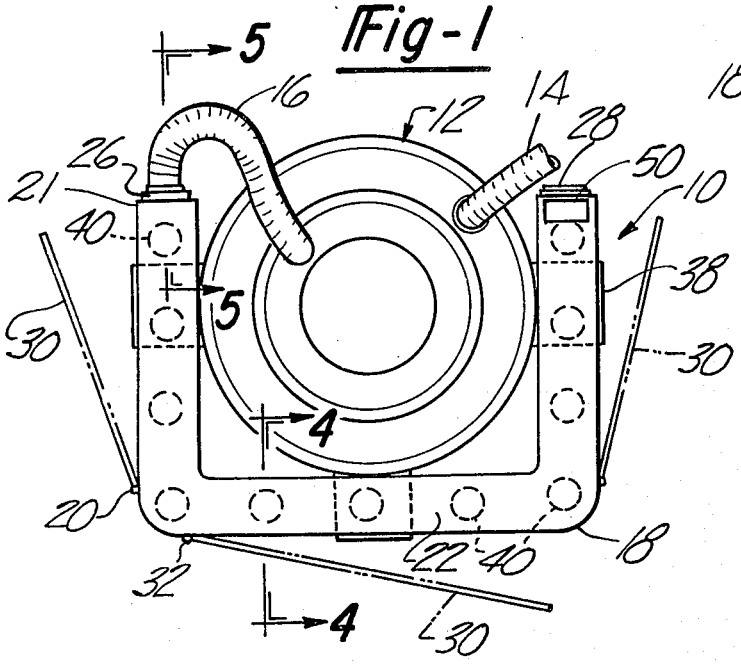
FIG. 1 is a top plane view of an ultraviolet lamp fixture constructed in accordance with the principles of the present invention.
Figure 2:
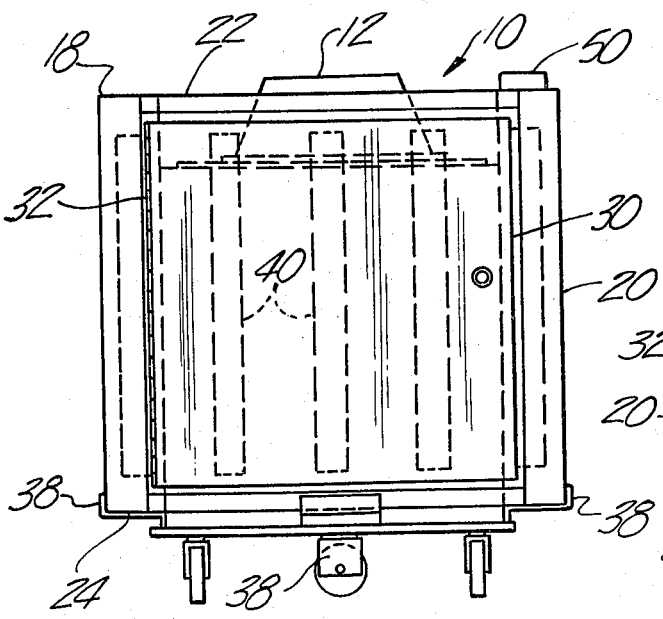
FIG. 2 is a front elevational view of the ultraviolet lamp fixture illustrated in FIG. 1.

Referring now to the drawing and, in particular, to FIGS. 1 and 2 wherein there is illustrated an example of the present invention in the form of an ultraviolet lamp fixture 10 in combination with a conventional commercial vacuum cleaner 12 comprising a U-shaped housing 18 having side wills 20, a top 22, and a bottom 24. The housing 18 is carried on the vacuum cleaner 12 by housing mounting brackets 38 attached to the vacuum cleaner 12 by any suitable means. The housing 18 may be fabricated in any suitable material and, preferably, the housing 18 is fabricated from sheet metal with the various side, top and bottom walls being fastened to each other in a conventional manner; that is, with threaded fastners or welding or the like, all of which is not described in detail as such fastening means do not pertain to the present invention and are well known to those skilled in the art of fabricating comparably shaped housings and the like from sheet metal and like material.

As can best be seen by FIG. 2, the interior of the housing 18 is provided with a plurality of longitudinally mounted ultraviolet ray tubes 40 so spaced from one another and from the walls of the housing 18 that substantially all of the air passing through the interior of the housing 18 will pass over at least one of the tubes 40, whereby the ultraviolet light emitted from the tubes 40 will kill disease-carrying organisms in the air.

Figure 4:
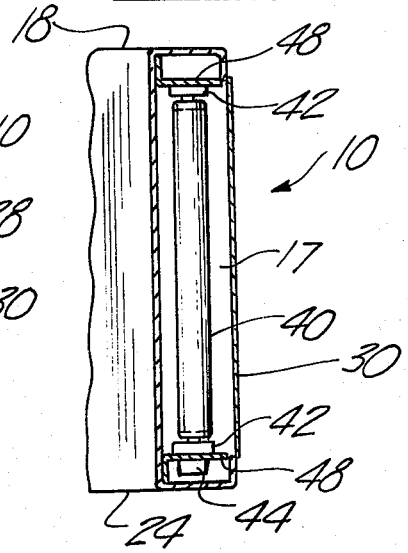
FIG. 4 is a sectional view of the ultraviolet lamp fixture taken along line 4—4 of FIG. 1.

As shown in FIG. 4, the ultraviolet tubes 40 are mounted at opposite ends in suitable sockets 42 carried on removable socket mounting brackets 48 which, in turn, are electrically connected to ballast 44. In using the ultraviolet lamp fixture 10 with an existing vacuum cleaner 12, the ballast 44 is connected to an on/off switch box 50, see FIG. 3, which is mounted at any suitable place on the housng 18, and which operates the ultraviolet tubes 40. As an alternate example, the vacuum cleaner's on/off switch may be co-operated with the ultraviolet tube's on/off switch 50.

Figure 5:
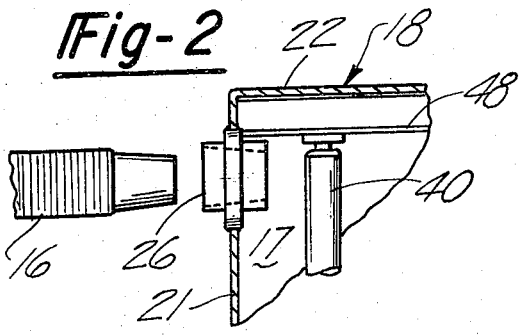
FIG. 5 is a fragmentary cross-sectional view of the ultraviolet lamp fixture taken along line 5—5 of FIG. 1.

Looking at FIG. 5, it can be seen that a flexible hose 16 projecting from the vacuum cleaner 12 connects to the ultraviolet lamp fixture 10 by means of an air intake aperture 26 on housing end 21 for the purpose of channeling the air from the vacuum cleaner 12 into the central chamber 17 of the housing 18 to permit the ultraviolet tubes 40 to act on the air.

Figure 3:
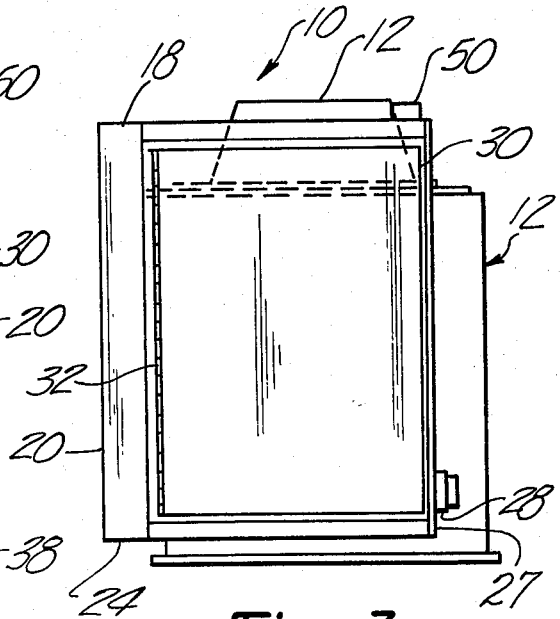
FIG. 3 is a fragmentary side elevational view of the ultraviolet lamp illustrated in FIG. 1.

As can best be seen in FIG. 1 and FIG. 3, an exhaust port 28 is provided near the bottom of the housing end 27 to release the purified air. The air exhaust aperture 28 has a diameter at least as great as the diameter of the air intake aperture to prevent a back pressure on the vacuum cleaner's motor.

Each side wall 20 has a door 30 hinged at 32 which provides an entry to the interior of the housing 18 for the purpose of cleaning and replacing the ultraviolet ray tubes 40.

Such cleaning is necessary since dust around an ultraviolet ray tube 40 could function to limit the effective kill rate of the ultraviolet radiation as such radiation cannot penetrate dust to any degree.

In use, the ultraviolet lamp fixture 10 is either attached to an existing commercial vacuum cleaner or made a part of a new vacuum cleaner. When the vacuum cleaner 12 is operable, the air from the room is drawn into the vacuum cleaner 12 through the intake hose 14 and is exhausted into the air exhaust hose 16 which channels the air into the interior of the housing 18 of the ultraviolet light fixture 10. As the air moves through the housing 18 past the ultraviolet tubes 40, the micro-organisms carried by such air should pass in close proximity to at least one and preferably several of the tubes 40 whereby an effective kill may be had. The so purified air is then exhausted back into the room through an exhaust aperture 28.

Ordinarily after a vacuum cleaner has removed the dust particles from the air in a room, the air is exhausted back into the room. It can be seen that the present invention has provided a new and improved lamp fixture 10 which interrupts this flow of air by channeling the exhausted air through an exposure to ultraviolet radiation whereby the micro-organisms carried by the air are effectively killed before the air is released back into the room from which it came.

It can also be seen that the housing 18 completely covers the ultraviolet tubes so that when the vacuum cleaner and light fixture are operable in a room, persons in the room will not have to protect their eyes from the rays of the tubes 40.

In addition, the vertical disposition of lamps offers a pleasing compactibility which insures easy storage and efficient movement in operation.

Although only one example of the present invention has been disclosed, it should be understood by those skilled in the art of ultraviolet lamp fixtures that other forms may be had all coming within the spirit of the invention and the scope of the appended claims.

What is claimed is as follows:

1. An ultraviolet light fixture attachment for converting a conventional vacuum cleaner into a germicidal unit, said fixture comprising:

an enclosed housing, the opposite ends of said housing providing respectively an air intake aperture and an air exhaust aperture, said housing defining an air passageway between said air intake and exhaust apertures;

means for releasably attaching said housing to the exterior of a conventional vacuum cleaner for converting said vacuum cleaner into a germicidal unit;

conduit means for channeling the air exhausted from said connected vacuum cleaner into said housing through said housing air intake aperture; and a plurality of ultraviolet ray tubes mounted in said housing in said air passageway between said air intake aperture and said air exhaust aperture whereby airborne microorganisms carried by the air exhausted from said vacuum cleaner may be destroyed.

2. The ultraviolet lamp fixture defined in claim 1 wherein the ultraviolet ray tubes are mounted longitudinally in the housing resulting in a compact design providing efficient utility and storage.

3. The ultraviolet light fixture defined in claim 1 wherein said housing is designed in a U shape to provide compatible and compact attachment to a standard existing vacuum cleaner thereby transforming said standard vacuum cleaner into a germicidal cleaning unit.

4. The ultraviolet light fixture defined in claim 1 further comprising a plurality of doors in said housing, each door, upon being opened, providing manual entry into the housing and permitting unencumbered access to said ultraviolet ray tubes whereby said tubes may be dusted manually and removed, if necessary.

* * * * *